US006644912B2

(12) United States Patent
Conrad

(10) Patent No.: US 6,644,912 B2
(45) Date of Patent: Nov. 11, 2003

(54) GAS FRICTION PUMP

(75) Inventor: Armin Conrad, Herborn (DE)

(73) Assignee: Pfeiffer Vacuum GmbH, Asslar (DE)

( * ) Notice: Subject to any disclaimer, the term of this patent is extended or adjusted under 35 U.S.C. 154(b) by 47 days.

(21) Appl. No.: 10/086,679

(22) Filed: Mar. 1, 2002

(65) Prior Publication Data

US 2002/0127094 A1 Sep. 12, 2002

(30) Foreign Application Priority Data

Mar. 10, 2001 (DE) ..... 101 11 603

(51) Int. Cl.[7] ..... F04D 19/04
(52) U.S. Cl. ..... 415/90; 417/423.4
(58) Field of Search ..... 415/90, 199.5, 415/194; 417/423.4, 250

(56) References Cited

U.S. PATENT DOCUMENTS 6,030,189 A * 2/2000 Bohm et al. ..... 417/423.4

* cited by examiner

*Primary Examiner*—Edward K. Look
*Assistant Examiner*—Kimya N McCoy
(74) *Attorney, Agent, or Firm*—Sidley Austin Brown & Wood, LLP

(57) ABSTRACT

A gas friction pump, including a housing having a suction opening, a gas outlet opening, and a plurality of rotatable and stationary components arranged in the housing and having a pump-active structure for pumping gases and maintaining a pressure ratio, and an additional gas inlet formed as a longitudinal opening extending, in a longitudinal direction thereof, over a portion of an outer edge of a rotatable component.

1 Claim, 1 Drawing Sheet

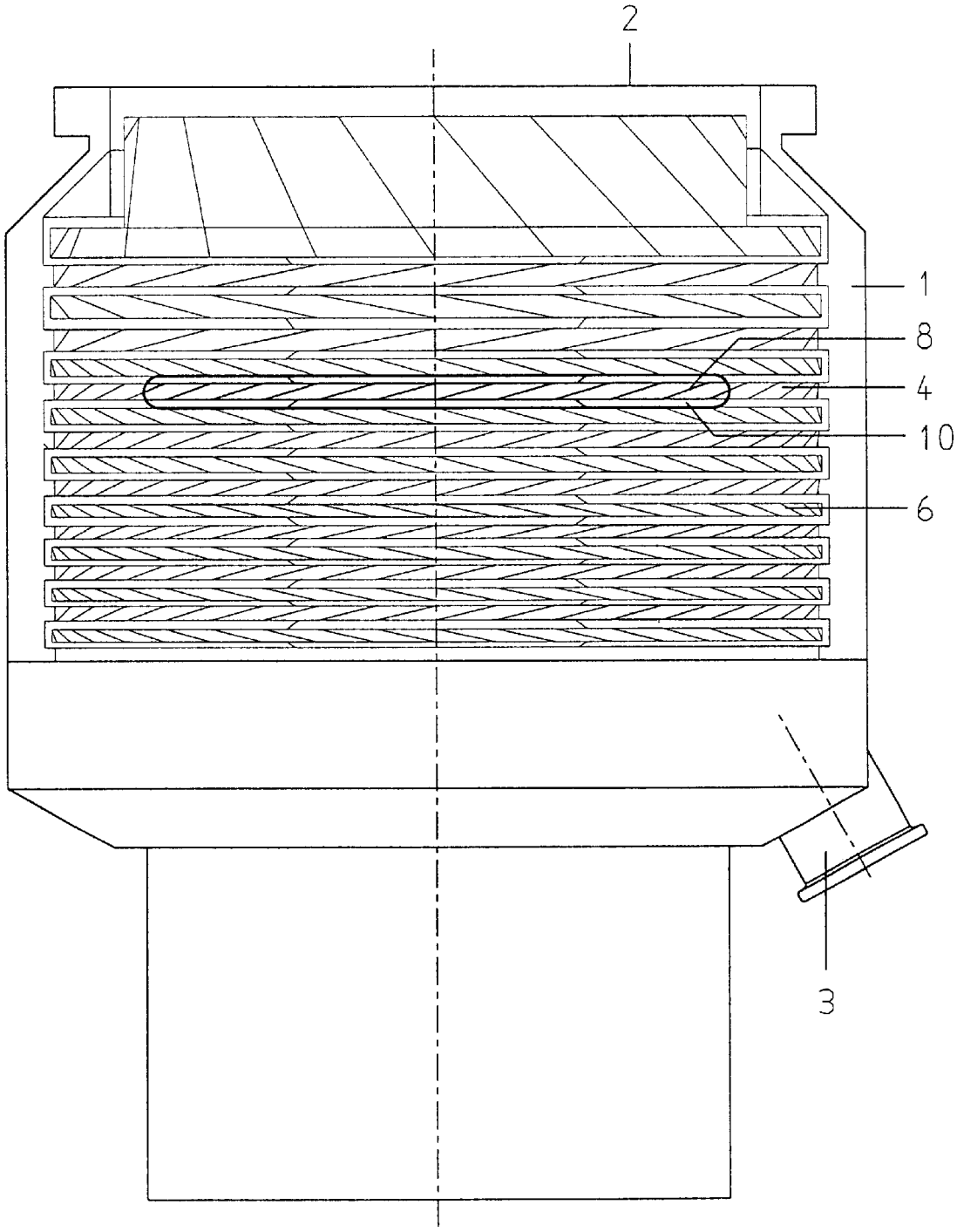
2
1
8
4
10
6
3

GAS FRICTION PUMP

BACKGROUND OF THE INVENTION

1. Field of Invention

The present invention relates to a gas friction pump including a housing having a suction opening, a gas outlet opening, and an additional gas inlet, and plurality of rotatable and stationary components arranged in the housing and having a pump-active structure for pumping gases and maintaining a pressure ratio.

2. Description of the Prior Art

Gas friction pumps of the type described above are well known and are widely used. When a gas friction pump is formed as a turbomolecular pump, the pump-active components are formed of discs provided with a blade crown. The rotatable and stationary components are arranged in the pump housing alternatively one behind the other. The cooperation of these disc-shaped components produces a pumping effect. Gases, which enter the pump through the suction opening, are compressed and are delivered to the forevacuum side. From the forevacuum side, the gases can be further compressed up to atmospheric pressure in internal or external pump stages. The external pump stages are connected with the forevacuum side by a forevacuum connection.

There are many reasons to provide, in a gas friction pump, in addition to a main suction opening, one or more further gas inlet. Some of these reasons are listed below:

If, e.g., a turbomolecular pump is not operating, it makes sense to flood the pump with a dry gas to prevent contamination caused by hydrocarbous and water, and to reduce the pumping time upon subsequent turning of the pump on. This is effected by using a valve provided on the pump circumference, with the gas flowing between two rotor discs, as described in German Publications DE-A 1809902 and DE-A 4427153.

Selected gases can be admitted for cooling a pump during its operation, as disclosed in a German Publication DE-A 19508566.

The suction capacity of a turbomolecular pump can be favorably influenced by delivering a portion of the gas flow from the area of high pressure to the high vacuum side at the height of the last discs, as disclosed in German Publication DE-A 19704234.

Turbomolecular pumps, which are used in leak detectors or analyzing systems, as a rule, are provided with gas inlets in several locations and which insure the gas flow between the rotor discs, as disclosed in German Publications DE-A 1648648 and DE-A 4331589.

In all of the cases described above, the gas is admitted through bores formed in the pump housing. This results in flow of gases in radial direction between the rotor discs. To be conducted further, the gas stream should be deflected by 90°. Such flow of gases in the prior art apparatuses results in a high flow resistance to the gas admittance, which reduces the desired effect and is associated with a significant time delay.

Accordingly, an object of the present invention is to provide an additional gas inlet in a gas friction pump at the level of rotor discs, which would insure, in comparison with the state of the art, a higher effectiveness and a more rapid initiation of a desired effect.

SUMMARY OF THE INVENTION

This and other objects of the present invention, which will become apparent hereinafter are achieved by forming the additional gas inlet as a longitudinal opening extending, in its longitudinal direction, over a portion of an outer edge of a rotatable component.

The arrangement of the additional gas inlet according to the present invention permits to significantly improve the flow characteristics of the additional gas flow arrangement. As a result, flow resistance is substantially reduced. This is because the additional gas flow does not need to enter through an inlet bore with formation of a narrow gas stream which, upon reaching the rotor discs, should be deflected.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

Single FIGURE of the drawings shows a schematic elevational view of a turbomolecular pump representing a gas friction pump according to the present invention.

DETAILED DESCRIPTION OF THE PREFERRED EMBODIMENT

A turbomolecular pump, which represents a gas friction pump according to the present invention and is shown in the drawing, includes a housing 1 having a suction opening 2 and an outlet opening 3. Within the housing 1, there are arranged rotor and stator discs 4 and 6, respectively, which are provided with a pump-active structure. In the turbomolecular pump shown in the drawing, the pump-active structure is formed by blade crowns formed of blades 8 which are inclined to the disc planes. In the circumference of the housing, there is provided an additional gas inlet 10 formed as an elongate opening. The gas inlet 10 extends, in its longitudinal direction, over a portion of an outer edge of a rotor disc 4.

Though the present invention was shown and described with references to the preferred embodiment, such is merely illustrative of the present invention and is not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claim.

What is claimed is:

1. A gas friction pump, comprising a housing having a suction opening, a gas outlet opening, and an additional gas inlet; and a plurality of rotatable and stationary components arranged in the housing and having a pump-active structure for pumping gases and maintaining a pressure ratio, wherein the additional gas inlet is formed as a longitudinal opening extending, in a circumferential direction thereof, over a portion of an outer edge of a rotatable component.

* * * * *